United States Patent [19]

Innami et al.

[11] Patent Number: 4,669,190

[45] Date of Patent: Jun. 2, 1987

[54] PORTABLE MOTOR-DRIVEN CUTTER

[75] Inventors: Tatsuo Innami, Mito; Katuo Koizumi, Naka; Toshiaki Imahashi; Kihachiro Matsumoto, both of Katsuta, all of Japan

[73] Assignee: Hitachi Koki Company, Ltd., Japan

[21] Appl. No.: 871,552

[22] Filed: Jun. 6, 1986

[51] Int. Cl.[4] ..... B26B 7/00

[52] U.S. Cl. ..... 30/273; 7/103

[58] Field of Search ..... 30/273, 275, 228; 7/103

[56] References Cited

U.S. PATENT DOCUMENTS

| | | | |
|---|---|---|---|
| 2,239,291 | 4/1941 | Martin | 30/273 |
| 3,189,997 | 6/1965 | Mount | 30/228 |
| 3,262,201 | 7/1966 | Docken | 30/228 X |
| 3,313,024 | 4/1967 | Bogusch | 30/273 |
| 3,538,523 | 11/1970 | Sparks | 7/103 |

*Primary Examiner*—Jimmy C. Peters

*Attorney, Agent, or Firm*—Lowe, Price, LeBlanc, Becker & Shur

[57] ABSTRACT

A portable motor-driven cutter for cutting off a sheet material includes an eccentric shaft rotatably supported by a gear case and a gear cover, an L-shaped driver arm having an upper end rotatably fitted over an eccentric portion of the eccentric shaft, a cutting blade detachably mounted on the lower end of the driver arm, and a scribing blade detachably mounted on a base on which the gear case is mounted. When the eccentric shaft is rotated by a motor, the cutting blade is moved in an eccentric pattern to cut off a sheet material along a straight line scribed by the scribing blade. The cutting blade and the scribing blade are produced from a single break-off disposable cutter blade.

9 Claims, 6 Drawing Figures

PORTABLE MOTOR-DRIVEN CUTTER

BACKGROUND OF THE INVENTION

The present invention relates to a portable motor-driven cutter for cutting off various thin sheets or panels such as plasterboards, sheathing boards, rubber sheets, carpets, and the like.

Thin sheets such as plasterboards and sheathing boards, for example, have heretofore been cut off by motor-driven circular saws or motor-driven jig saws. However, these saws are disadvantageous in that when cutting off those sheet materials, they produce a large amount of sawdust which will impair the working environment for the worker and will be scattered and deposited over a wide area. Another difficulty of these conventional saws is that they cannot neatly finish the cut surfaces of the sheet panel, but leave irregular cut surfaces with many burrs thereon.

As shown in FIG. 6 of the accompanying drawings, it has been customary to cut off a rubber sheet or carpet 54 with a hand-held knife 53. This practice however requires the knife user to be highly skilled, physically fatigues the knife user, and results in poor efficiency.

SUMMARY OF THE INVENTION

It is an object of the present invention to provide a portable motor-driven cutter which will not produce a large amount of dust when cutting off sheet materials, and which can neatly finish cut surfaces so that they are free of burrs.

Another object of the present invention is to provide a portable motor-driven cutter which can move well along a straight line on a sheet material to cut off the sheet material along straight edges.

Still another object of the present invention is to provide a portable motor-driven cutter which employs a break-off disposable cutter blade that is widely used and easily available to users.

A still further object of the present invention is to provide portable motor-driven cutter including a safe mechanism for breaking a break-off disposable cutter blade.

According to the present invention, a portable motor-driven cutter for cutting off a sheet material includes an eccentric shaft rotatably supported by a gear case and a gear cover, an L-shaped driver arm having an upper end rotatably fitted over an eccentric portion of the eccentric shaft, a cutting blade detachably mounted on the lower end of the driver arm, and a scribing blade detachably mounted on a base on which the gear case is mounted. When the eccentric shaft is rotated by a motor, the cutting blade is moved in an eccentric pattern to cut off a sheet material along a straight line scribed by the scribing blade. The cutting blade and the scribing blade are produced from a single break-off disposable cutter blade.

BRIEF DESCRIPTION OF THE DRAWINGS

The present invention will be described in detail by way of illustrative example with reference to the accompanying drawings, in which.

DETAILED DESCRIPTION

Figure 1:
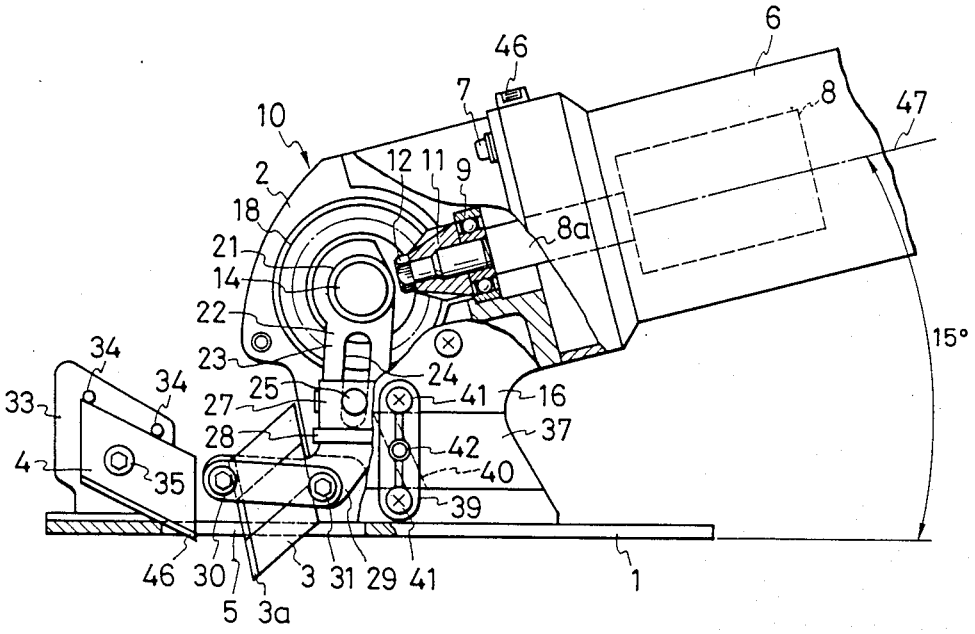
FIG. 1 is a front elevational view, partly broken away, of a portable motor-driven cutter according to the present invention.
Figure 2:
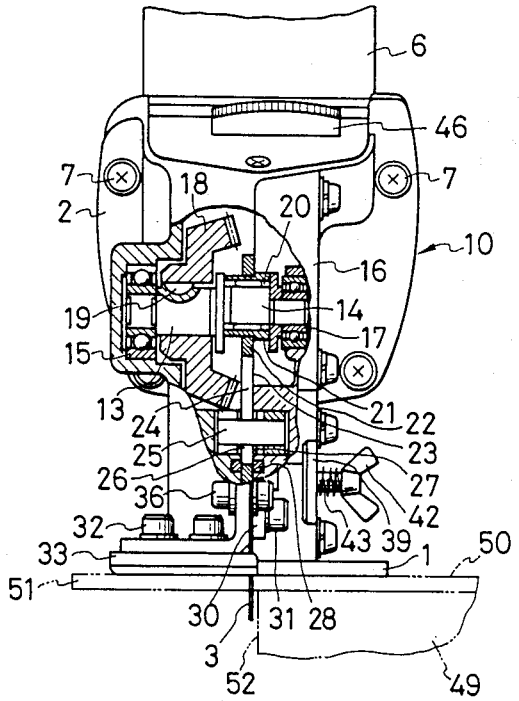
FIG. 2 is a side elevational view, partly broken away, of the portable motor-driven cutter shown in FIG. 1.
Figure 3:
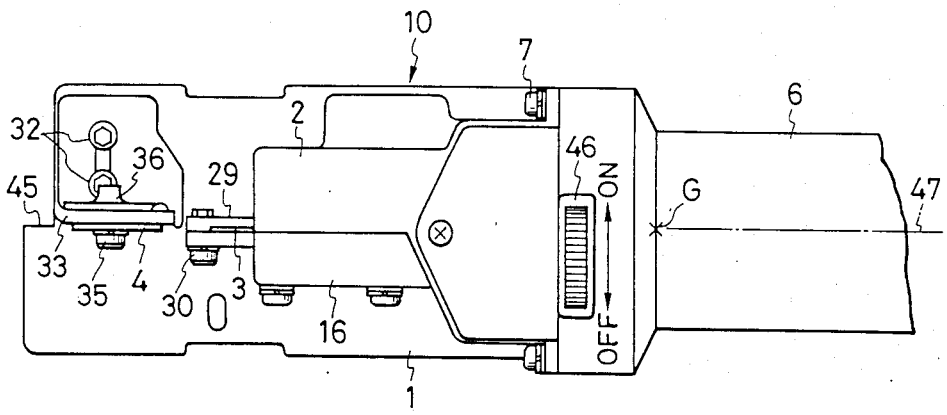
FIG. 3 is a plan view of the portable motor-driven cutter shown in FIG. 1.

As shown in FIGS. 1 through 3, a portable motor-driven cutter, generally designated by the reference numeral 10, includes a gear case 2 having a lower end detachably secured to the upper surface of a base 1 by screws (not shown). As shown in FIG. 1, the base 1 has a hole 5 for allowing a cutting blade 3 and a scribing blade 4 in front of the cutting blade 3 to project downwardly below the lower surface of the base 1. The hole 5 is elongate in the direction in which the cutter 10 is moved to cut off a sheet material. The cutting blade 3 has a cutting edge 3*a* projecting relatively largely from the hole 5 and the scribing blade 4 has a cutting edge 4*a* projecting slightly from the hole 5.

A motor housing 6 doubling as a grip handle extends in the direction in which the cutter 10 is movable and is inclined upwardly and rearwardly to an angle of about 15° to the base 1. The gear case 2 is fixed to the front end of the motor housing 6 by means of four screws 7.

The motor housing 6 accommodates therein an electric motor 8 having a motor shaft 8*a* with its rear end rotatably supported by a bearing (not shown) in the motor housing 6 and its front end rotatably supported by a bearing 9 in the gear case 2. A smaller-diameter bevel gear 11 is fixed by a bolt 12 to the distal end of the motor shaft 8.

As illustrated in FIG. 2, an eccentric shaft 13 having a substantially central eccentric portion 14 is rotatably supported at one end thereof by a bearing 15 in the gear case 2 and at the opposite end by a bearing 17 in a gear cover 16 fixed to the gear case 2.

A larger-diameter bevel gear 18 is fixed by a key 19 to the eccentric shaft 13 at a position spaced from the eccentric portion 14, the larger-diameter bevel gear 18 being held in mesh with the smaller-diameter bevel gear 11. Over the eccentric portion 14, there is fitted a needle bearing 20 having a collar 21 over which there is rotatably fitted the upper end of a vertical arm member 23 of an L-shaped driver arm 22 (FIG. 1). The arm member 23 has a vertically elongate slot 24 through which there extends, with a small clearance, a guide pin 25 having its opposite ends supported by the gear case 2 and the gear cover 16, as shown in FIG. 2. The arm member 23 has opposite sides held against liners 26, 27, respectively, disposed around the guide pin 25. A body 28 of felt is held against the outer surface of the arm member 23 below the liners 26, 27 for preventing oil in the gear case 2 from leaking out along the arm member 23. The driver arm 22 also includes a horizontal arm member 29 serving as a cutter blade attachment base to which the cutting blade 3 is detachably fastened by an attachment member 30 and bolts 31.

The scribing blade 4 is detachably secured by a bolt 35 and a nut 36 to a holder 33 that is fixed to a front portion of the base 1 by means of screws 32. The holder 33 has a pair of positioning pins 34. To attach the scribing blade 4 in position, the bolt 35 and the nut 36 are tightened together while the upper edge of the scribing blade 4 remote from the scribing edge 4*a* is being held against the positioning pins 34.

Figure 4:
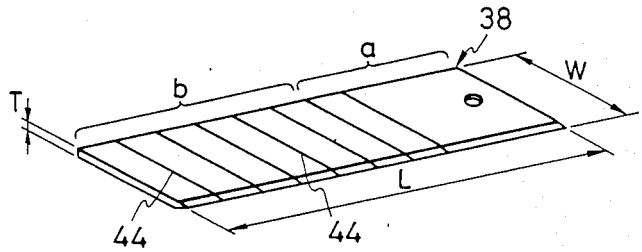
FIG. 4 is a perspective view of a commercially available break-off disposable cutter blade that can be broken off into both a cutting blade and a scribing blade to be used on the portable motor-driven cutter of the present invention.

The gear cover 16 has a horizontal recess 37 defined in a lower side thereof and having such a width and a depth that it can receive a break-off disposable cutter blade 38 as shown in FIG. 4. A vertical bolt holder 39 is attached by screws 41 to the gear cover 16 across the horizontal recess 37. The horizontal recess 37 includes an inclined clearance groove 40 extending adjacent to the bolt holder 39. In the embodiment, the break-off disposable cutter blade 38 has a length L of 100 mm, a width W of 18 mm, and a thickness T of 0.5 mm. The recess 37 may be defined in side of the gear case 2 or in both sides of the gear case 2 and the gear cover 16.

A bolt 42 with a butterfly-shaped head is threaded centrally in the bolt holder 39. The bolt 42 is prevented from being loosened by a coil spring 43 disposed around the bolt 42.

The cutting blade 3 and the scribing blade 4 are produced from the break-off disposable cutter blade 38 shown in FIG. 4. The break-off disposable cutter blade 38 has a series of parallel spaced break-off grooves 44 where it can be broken off. The cutter blade 38 is broken off into a portion a that is used as the scribing blade 4 and a portion b that is used as the cutting blade 3. The break-off disposable cutter blade 38 can thus be broken off by inserting the cutter blade 38 in the recess 37 below the bolt holder 39 until a desired one of the break-off grooves 44 is alined with the tip of the bolt 42, and then turning in the bolt 42 against the cutter blade 38 to force the tip of the bolt 42 to press the cutter blade 38 and break it off along the groove 44. The scribing blade 4 as it is mounted on the holder 33 is positionally adjustable by loosening the bolts 32, repositioning the holder 33, and re-tightening the bolts 32.

As shown in FIG. 3, the base 1 has a vertical end face 45. This end face 45, the scribing blade 4, and the cutting blade 3 are aligned with each other within a vertical plane parallel to the direction in which the cutter 10 is movable to cut off a sheet material. The motor housing 6 has a central axis 47 and the cutter 10 has a center of gravity G. These central axis 47 and center of gravity G are also positioned in such a vertical plane.

The motor housing 6 supports a switch button 46 which is electrically connected to the motor 8 and a power supply (not shown) such as a storage battery attached to the motor housing 6. The motor 8 can be energized and deenergized by shifting the switch button 46 to an ON position and an OFF position, respectively, as shown in FIG. 3.

Figure 5:
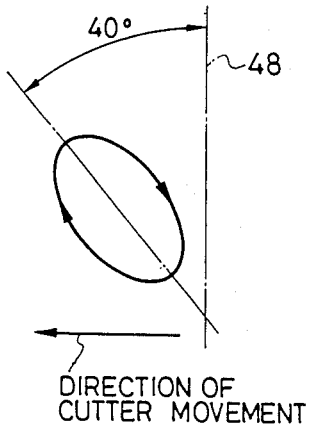
FIG. 5 is an enlarged diagram showing the path of movement of the cutting blade on the portable motor-driven cutter of the present invention.
Figure 6:
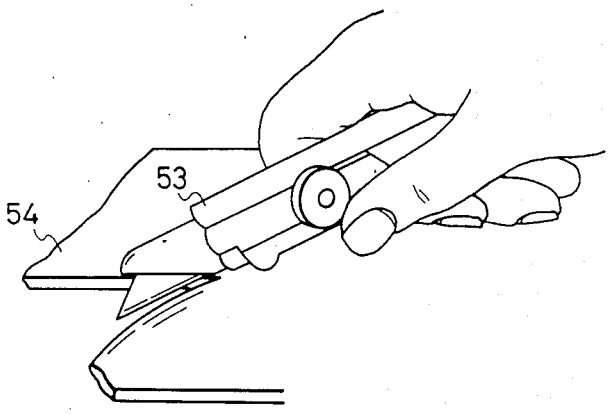
FIG. 6 PRIOR ART
FIG. 6 is a perspective view showing a conventional practice of cutting off a rubber sheet or carpet with a hand-held cutter blade.

In operation, the switch button 46 is moved to the ON position to energize the motor 8 for thereby rotating the motor shaft 8*a*. The eccentric shaft 13 is now rotated by the motor shaft 8*a* through the bevel gears 11, 18. Since the vertical arm member 23 of the driver arm 22 is guided by the guide pin 25, the driver arm 22 is vertically and horizontally moved upon rotation of the eccentric shaft 13. As a result, the horizontal arm member 29 moves in an elliptical pattern, as shown in FIG. 5, which is vertically elongate and has its major axis inclined forwardly about 40° to the vertical line 48. Therefore, the cutting blade 3 also moves in the same forwardly inclined, vertically elongate elliptical pattern.

For cutting off a sheet 50 (FIG. 50) such as a plasterboard or a sheathing board with the cutter 10, the sheet 50 is placed on a bed 49 with a portion 51 to be cut off projecting from an end 52 of the bed 49, and the end face 49 of the base 1 of the cutter 10 is aligned with a marked line on the sheet 50 along which it is to be cut off. When the cutter 10 as it operates is manually moved, the upper surface of the sheet 50 is scribed along the marked line by the scribing blade 4, and then the sheet 50 is cut off along the scribed line by the cutting blade 3. No burrs are produced when the sheet 50 is cut off by the cutting blade 3 because a shallow groove has been formed by the scribing blade 4 along the scribed line, so that the cut edges are neatly finished. Any dust produced from the sheet 50 when it is cut off by the cutting blade 3 is quite small in quantity. The cutter 10 can move along a straight line to produce straight cut edges for the reason that the scribing blade 4, the cutting blade 3, the central axis 47 of the motor housing 6, and the center of gravity G of the cutter 10 are positioned in a vertical plane parallel to the direction of movement of the cutter 10.

The recess 37, the bolt holder 39, and the bolt 42 jointly constitute a blade break-off mechanism for enabling the user to break off the break-off disposable cutter blade 38 safely without touching the cutter blade 38 once it has been inserted in place in the recess 37.

Although a certain preferred embodiment of the present invention has been shown and described in detail, it should be understood that various changes and modifications may be made therein without departing from the scope of the appended claims.

We claim:

1. A portable motor-driven cutter for cutting off a sheet material, comprising:

a motor housing accommodating an electric motor therein and doubling as a grip handle, said motor housing extending substantially in a direction in which said cutter is moved to cut off a sheet material;

a gear case fixedly mounted on one end of said motor housing;

a gear cover attached to said gear case;

an eccentric shaft rotatably supported by said gear case and said gear cover and extending substantially horizontally and transversely to said direction, said eccentric shaft including an eccentric portion;

a gear mechanism disposed in said gear case for transmitting rotative power from said motor to said eccentric shaft;

a substantially L-shaped driver arm including a substantially vertical arm member having a vertically elongate slot and a substantially horizontal arm member serving as a blade attachment base, said vertical arm member having an upper end rotatably fitted over said eccentric portion of said eccentric shaft;

a guide pin supported by said gear case and said gear cover below said eccentric shaft and extending through said slot;

a base attached to a lower end of said gear case and having a hole elongate in said direction;

a cutting blade detachably mounted on said blade attachment base and projecting through said hole below said base; and a scribing blade detachably mounted on said base and having a lower end projecting slightly from said hole.

2. A portable motor-driven cutter according to claim 1, wherein said cutting blade, said scribing blade, and the central axis of said motor housing are aligned within a vertical plane parallel to said direction.

3. A portable motor-driven cutter according to claim 2, wherein said cutter has a center of gravity positioned in said vertical plane.

4. A portable motor-driven cutter according to claim 1, wherein said cutting blade and said scribing blade are produced from a single break-off disposable cutter blade.

5. A portable motor-driven cutter according to claim 1, wherein said gear cover has a blade break-off mechanism for breaking off a break-off disposable cutter into said cutting blade and said scribing blade.

6. A portable motor-driven cutter according to claim 5, wherein said blade break-off mechanism comprises a recess defined in said gear cover, a bolt holder attached to said gear cover over said recess, and a bolt threaded in said bolt holder to project a tip thereof into said recess.

7. A portable motor-driven cutter according to claim 1, further including a holder positionally adjustably mounted on said base, said scribing blade being detachably mounted on said holder.

8. A portable motor-driven cutter according to claim 7, wherein said holder has a pair of positioning pins against which said scribing blade is held.

9. A portable motor-driven cutter according to claim 1, wherein said gear mechanism comprises a smaller-diameter bevel gear mounted on the motor shaft of said motor and a larger-diameter bevel gear mounted on said eccentric shaft and held in mesh with said smaller-diameter bevel gear.

* * * * *